US005295889A

United States Patent [19]

Ejima

[11] Patent Number: 5,295,889

[45] Date of Patent: Mar. 22, 1994

[54] MAGNETICALLY JOINTED TOY FOR EMITTING STIMULI

[75] Inventor: Takio Ejima, Sakura, Japan

[73] Assignee: Takara Co., Ltd., Tokyo, Japan

[21] Appl. No.: 932,264

[22] Filed: Aug. 19, 1992

[30] Foreign Application Priority Data

Jul. 6, 1992 [JP] Japan ..... 4-202044

[51] Int. Cl.[5] ..... A63H 33/06; A63H 3/28

[52] U.S. Cl. ..... 446/91; 446/97; 446/130; 446/297

[58] Field of Search ..... 446/91, 92, 99, 97, 446/130, 137, 139, 303, 297, 397, 484, 485; 273/156

[56] References Cited

U.S. PATENT DOCUMENTS

| | | | |
|---|---|---|---|
| 3,447,249 | 6/1969 | Greger | 446/91 X |
| 4,038,775 | 8/1977 | Sato | 446/92 |
| 4,176,492 | 12/1979 | Sims et al. | 446/92 |
| 4,820,233 | 4/1989 | Weiner | 446/303 |
| 4,869,701 | 9/1989 | Kawai et al. | 446/91 |

*Primary Examiner*—Mickey Yu

*Attorney, Agent, or Firm*—Price, Gess & Ubell

[57] ABSTRACT

A combined toy capable of permitting a user to enjoy play full of unexpectedness and/or novelty. The combined toy includes a toy body constituted by a trunk, and attachments including a head, arms and legs detachably combined with the trunk. Combining between the trunk and the attachments is carried out using magnetic force. Also, a sound producing unit and a light emitting unit are provided in the toy body and/or attachments so as to be actuated when the attachments each are combined with the toy body.

12 Claims, 3 Drawing Sheets

MAGNETICALLY JOINTED TOY FOR EMITTING STIMULI

BACKGROUND OF THE INVENTION

This invention relates to a combined toy, and more particularly to a combined toy which includes a toy body and at least one attachment detachably combined with the toy body and is adapted to actuate a stimulus producing means for producing at least one predetermined stimulus appealing to the sense such as at least one of a sound producing unit and a light emitting unit arranged in at least one of the toy body and attachment when the attachment is combined with the toy body.

A conventional combined toy generally includes a toy body and a plurality of attachments, wherein a user combines the attachments with the toy body to assemble the combined toy into a predetermined configuration, to thereby enjoy play. Unfortunately, the combined toy is merely constructed so as to permit a user to assemble the combined toy, therefore, it fails to provide the user with play full of unexpectedness and novelty. Thus, the conventional combined toy readily loses its popularity with time.

SUMMARY OF THE INVENTION

The present invention has been made in view of the foregoing disadvantage of the prior art.

Accordingly, it is an object of the present invention to provide a combined toy which is capable of permitting a user to enjoy play full of unexpectedness and/or novelty.

It is another object of the present invention to provide a combined toy which is capable of permitting a user to widely develop play through assembling of the combined toy.

It is a further object of the present invention to provide a combined toy of which a structure is significantly simplified.

In accordance with the present invention, a combined toy is provided. The combined toy includes a toy body, at least one attachment detachably combined with said toy body and a stimulus producing means for producing at least one predetermined stimulus appealing to the sense. The stimulus producing means is provided in at least one of the toy body and attachment so as to be actuated when the attachment is combined with the toy body.

In a preferred embodiment of the present invention, the stimulus producing means comprises at least one of a sound producing unit and a light emitting unit.

In a preferred embodiment of the present invention, combination of the attachment with the toy body permits the sound producing unit to produce a sound corresponding to the combination.

In a preferred embodiment of the present invention, the combination further permits the light emitting unit to emit light.

In a preferred embodiment of the present invention, combination of the attachment with the toy body is carried out by magnetic force.

In a preferred embodiment of the present invention, the combined toy is an assembled imitation of a robot, wherein a plurality of the attachments are combined with the toy body. The toy body comprises a trunk and the attachments comprises a head, a pair of arms, and a pair of legs.

The combined toy of the present invention constructed as described above is readily assembled by combining the attachment with the toy body. Also, the combination permits at least one of the sound producing unit and light emitting unit provided in at least one of the toy body and attachment to be actuated. Thus, it will be noted that the combined toy of the present invention provides a user with play full of unexpectedness and/or novelty and extensively develop the play.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

A combined toy according to the present invention will be described hereinafter with reference to the accompanying drawings.

Figure 1:
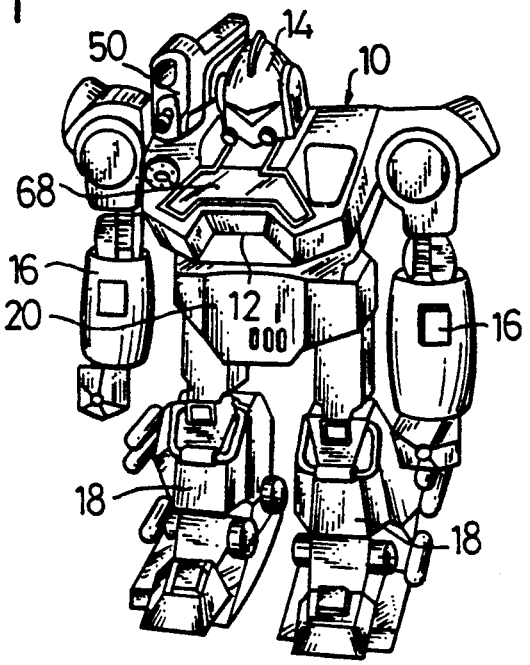
FIG. 1 is a perspective view generally showing an embodiment of a combined toy according to the present invention.
Figure 2:
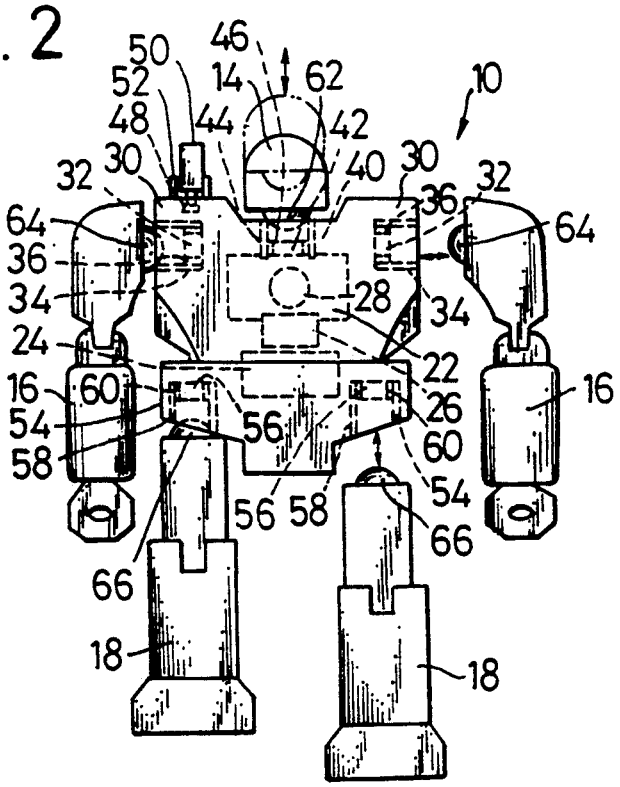
FIG. 2 is a schematic front elevation view showing an internal structure of the combined toy shown in FIG. 1.

Referring first to FIGS. 1 and 2, an embodiment of a combined toy according to the present invention is shown, in which a combined toy is generally designated at reference numeral 10. The combined toy may be constructed so as to exhibit a configuration in imitation of any actual thing when it is assembled. In the illustrated embodiment, it is constructed so as to exhibit a configuration like a robot when assembled. The combined toy 10 generally includes a trunk 12 constituting a toy body, and a head 14, a pair of arms 16 and a pair of legs 18 which constitute attachments and are detachably combined with or connected to the toy body 12.

Figure 3:
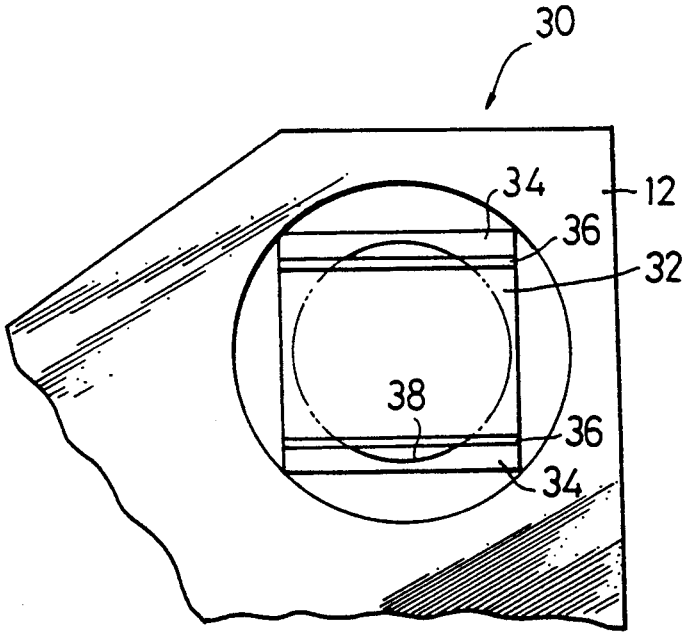
FIG. 3 is a fragmentary enlarged side elevation view showing the manner of connection between a trunk and an arm.
Figure 4:
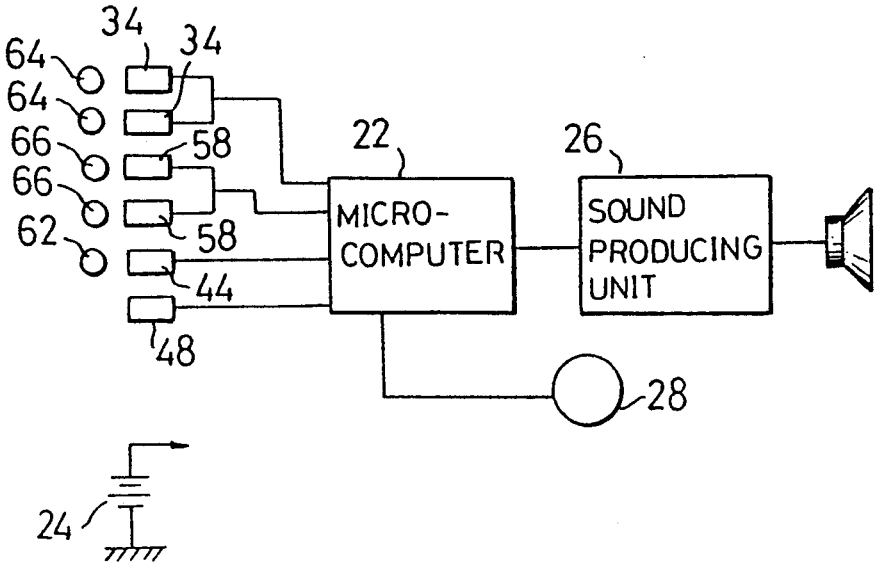
FIG. 4 is a block diagram showing electrical components incorporated in the combined toy shown in FIG. 1.

The trunk 12 is mounted on a lower side thereof with a waist 20 in a manner to be integral therewith. In the trunk 12 are arranged a microcomputer 22, a replaceable battery means 24 for a power supply, and a stimulus producing means for producing at least one predetermined stimulus appealing to the sense in a manner to be positioned at a central area of the trunk 12. In the illustrated embodiment, the stimulus producing means includes a sound producing unit 26 comprising a sound synthesizing IC and a light emitting unit 28. Also, the trunk 12 is provided therein with a pair of first coupling sections 30 in a manner to be positioned on both sides of an upper portion of the trunk 12, through which the arms 16 are detachably combined with or joined to the trunk 12. The first coupling sections 30 each include a magnet 32 arranged in a recess formed in the trunk 12 and a pair of conductive iron elements 34 magnetically securely fixed on upper and lower surfaces of the magnet 32 in parallel to each other through thin insulating members 36, respectively. The iron elements 34 each are arranged in such a manner that an outer distal end thereof extends in a lateral direction of the trunk 12 and is exposed. The conductive iron elements 34 are magnetized by the magnet 32, resulting in providing a pair of magnetic poles and provided at an outer distal end thereof with a hemispherical recess 38 in a manner to extend therebetween as shown in FIG. 3, resulting in acting also as an electrical contact operated by a conductive hemispherical member provided in the attachment 16 which will be described hereinafter. Also, the trunk 12, as shown in FIG. 2, is provided therein with a second coupling section 40 so as to be positioned at a center of an upper portion thereof, through which the head 14 is detachably connected to the trunk 12. The second coupling section 40 includes a magnet 42 and a pair of conductive iron elements 44 magnetically securely fixed on both side surfaces of the magnet 42 through thin insulating members 46, respectively. The iron elements 44 each are magnetized so as to act as a contact and arranged in such a manner that an outer distal end thereof extends in a lateral direction of the trunk 12 and is exposed.

The trunk 12 is further provided therein with a switch 48 in a manner to be in proximity to a shoulder on one side thereof. Also, the trunk 12 is movably mounted on an outside of the shoulder thereof with a movable member 50 through a support member 52 in a manner to be vertically movable about the support member 52. The movable member 50 is formed into a shape like firearms and operatively connected to the switch 48, so that vertical movement of the movable member 50 permits the switch 48 to be operated.

The waist 20 formed integral with the trunk 12 is provided therein with a pair of coupling sections 54 in a manner to be in proximity to both sides of a lower portion thereof, through which the legs 18 are detachably connected to the waist 20. The coupling sections 54 each include a magnet 56 and a pair of conductive iron elements 58 magnetically securely fixed on both sides of the magnet 56 through thin insulating members 60, respectively. The iron elements 34 are adapted to function as a contact and arranged in such a manner that an outer distal end thereof extends in a downward direction of the waist 20 and is exposed.

The microcomputer 22, sound producing unit 26, light emitting unit 28, battery means 24, iron elements 34, 44 and 58, and switch 48 are electrically connected to each other.

The head 14, as shown in FIG. 2, is provided therein with a magnetic and conductive member 62 of a hemispherical shape in a manner to be positioned at a center of a lower portion thereof. The conductive member 62 is formed so as to correspond to the second coupling section 40 of the trunk 12 and be magnetically detachably coupled thereto. The arms 16 each are provided therein with magnetic and conductive members 64 of a hemispherical shape in a manner to be positioned on an inner side of a proximal portion thereof. The conductive members 64 each are formed so as to correspond to the first coupling section 30 of the trunk 12 and be magnetically detachably coupled thereto. Further, the legs 18 each are provided on a proximal portion thereof with magnetic and conductive members 66 of a hemispherical shape, which are formed so as to correspond to the coupling sections 54 of the waist 20 and be magnetically detachably coupled thereto.

Now, the manner of operation of the combined toy of the illustrated embodiment constructed as described above will be described hereinafter.

In the combined toy 10 assembled as shown in FIG. 1, the movable member 50 formed in imitation of firearms is actuated or vertically moved to operate or turn on the switch 48. While keeping the switch 48 turned on, the sound producing unit 26 may be actuated to permit a sound to be produced therefrom while being controlled and selected by the microcomputer 22. Simultaneously or alternatively, the light emitting unit 28 may be actuated to emit light therefrom. More particularly, the combined toy 10 may not only permit a sound which indicates connection of the head 14 to the second coupling section 40 of the trunk 12 by means of magnetic force to be produced from the sound producing unit 26 during assembling of the toy while being selectively controlled by the microcomputer 22, but actuate the light emitting unit 28. In addition, the combined toy may permit a sound which indicates connection of the arms 16 to the first coupling sections 30 of the trunk 12 by means of magnetic force to be produced from the sound producing unit 26 during assembling of the toy while being selectively controlled by the microcomputer 22 and concurrently actuate the light emitting unit 28. Likewise, it may permit a sound indicating connection of the legs 18 to the coupling sections 54 of the waist 20 by means of magnetic force to be produced from the sound producing unit 26 during assembling of the toy while being selectively controlled by the microcomputer 22, and concurrently actuate the light emitting unit 28. The sound producing unit 26 and light emitting unit 28 each may be constructed so as to stop the actuation in a predetermined period of time. The combined toy 10 may be constructed so as to permit light discharged from the light emitting unit 28 to be observed through a front of the trunk 12. For this purpose, the trunk 12 is formed at a center of an upper portion thereof of a cover member 68 of a light-permeable material, as shown in FIG. 1.

As can be seen from the foregoing, the combined toy of the illustrated embodiment may be readily assembled by detachably combinedly connecting the attachments or the head 14, arms 16 and legs 18 to the toy body or trunk 12. Also, any combination of the attachments to the toy body may permit a sound corresponding to the combination to be produced from the sound producing unit 26 while being selectively controlled by the microcomputer 22 arranged in the toy body and light to be emitted from the light emitting unit 28. Thus, it will be noted that the combined toy of the present invention permits a user to enjoy play of unexpectedness and/or novelty and widely develop the play.

Figure 5:
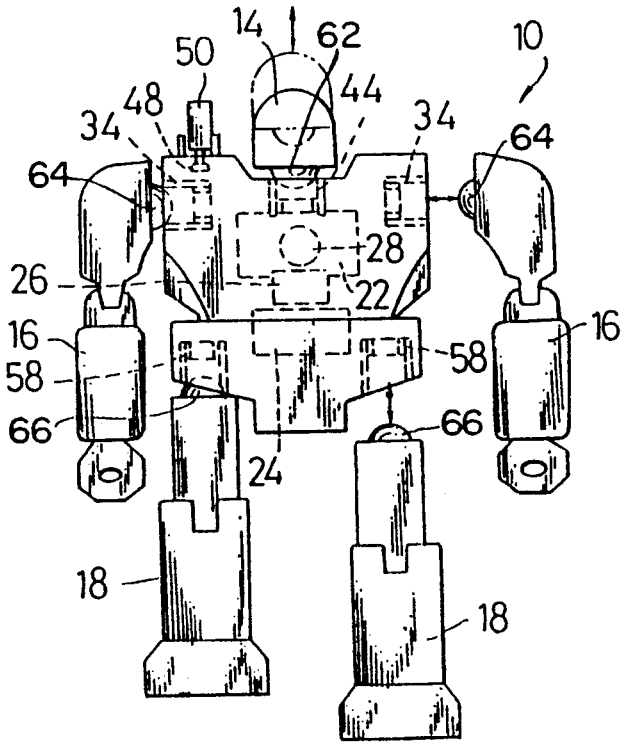
FIG. 5 is a schematic front elevation, view showing an internal structure of another embodiment of a combined toy according to the present invention.

Referring now to FIG. 5 showing another embodiment of a combined toy according to the present invention, a combined toy 10 of the illustrated embodiment is so constructed that a head 14, each of arms 16, and each of legs 18 include members made of a magnetic and conductive material, respectively. Such construction permits the combined toy of the illustrated embodiment to exhibit the same function as the embodiment described above. The remaining part of the illustrated embodiment may be constructed in substantially the same manner as the above-described embodiment.

As can be seen from the foregoing, the combined toy of the present invention is readily assembled by combining the attachments with the toy body. Also, the combination permits the stimulus producing means or the sound producing unit and light emitting unit provided in at least one of the toy body and attachments to be actuated. Thus, it will be noted that the combined toy of the present invention provides a user with play full of unexpectedness and/or novelty, as well as permit the play to be extensively developed.

What is claimed is:

1. A combined toy comprising:

a toy body;

at least one attachment detachably combined with said toy body;

means for attaching the toy body and the attachment including a magnet, a pair of conductive elements sandwiching the magnet, and a semispherical electrically conductive member, which will be attracted by the magnetic force field to adhere to the conductive elements;

a stimulus producing means for producing at least one predetermined stimulus appealing to the sensitory senses of a human; and circuit means for interconnecting the means for attaching and the stimulus producing means so that the connection of the semispherical electrically conductive member will activate the stimulus producing means, said stimulus producing means being provided in at least one of said toy body and attachment so as to be actuated when said attachment is combined with said toy body.

2. A combined toy as defined in claim 1, wherein said stimulus producing means comprises at least one of a sound producing unit and a light emitting unit.

3. A combined toy as defined in claim 2, wherein combination of said attachment with said toy body permits said sound producing unit to produce a sound indicative of said combination.

4. A combined toy as defined in claim 3, wherein said combination further permits said light emitting unit to emit light.

5. A combined toy as defined in claim 1, wherein said combined toy is an imitation of a robot.

6. A combined toy as defined in claim 5, wherein a plurality, of said attachments are combined with said toy body.

7. A combined toy as defined in claim 6, wherein said toy body comprises a trunk; and said attachments comprise a head, a pair of arms, and a pair of legs.

8. A robotic humanoid toy comprising:

a toy trunk body;

a plurality of attachments, including a head, a pair of arms and a pair of legs, detachably combined with the toy trunk body; and a stimulus producing means for producing predetermined stimulus perceivably by a human, including a selecting means for selecting a different stimulus to be produced corresponding to each particular attachment combined with the toy trunk body so that, when one of the attachments is connected to the toy trunk body, the stimulus producing means produces a stimulus which corresponds to that attachment.

9. A robotic humanoid as defined in claim 8, wherein said stimulus producing means comprises at least one of a sound producing unit and a light emitting unit.

10. A robotic humanoid toy as defined in claim 9, wherein a combination of at least one attachment with said toy trunk body further permits said light emitting unit to emit light.

11. A robotic humanoid toy as defined in claim 8, wherein a combination of said attachments with said toy trunk body is carried out by magnetic force.

12. A combined toy comprising:

a toy body;

at least one attachment detachably combined with said toy body;

means for attaching the toy body and the attachments, including a pair of conductive elements, a semispherical electrically conductive member and means for providing a magnetic force field to hold the respective pairs of conductive elements and semispherical electrically conductive member together;

a stimulus producing means for producing at least one predetermined stimulus appealing to the sensitory senses of a human; and circuit means for interconnecting the means for attaching and the stimulus producing means so that the connection of the semispherical electrically conductive member will activate the stimulus producing means, said stimulus producing means being provided in at least one of said toy body and attachment so as to be actuated when said attachment is combined with said toy body.

* * * * *